US007245736B2

(12) United States Patent
Tsunoda et al.

(10) Patent No.: US 7,245,736 B2
(45) Date of Patent: Jul. 17, 2007

(54) HEADPHONE DEVICE

(75) Inventors: Naotaka Tsunoda, Tokyo (JP); Koji Nageno, Tokyo (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 11/444,805

(22) Filed: Jun. 1, 2006

(65) Prior Publication Data

US 2006/0222197 A1 Oct. 5, 2006

Related U.S. Application Data

(63) Continuation of application No. 09/914,976, filed as application No. PCT/JP00/09426 on Dec. 28, 2000, now abandoned.

(30) Foreign Application Priority Data

Jan. 7, 2000 (JP) ..... P2000-005975

(51) Int. Cl.
*H04R 25/00* (2006.01)

(52) U.S. Cl. ..... 381/371; 381/370; 381/376

(58) Field of Classification Search ..... 381/309, 381/370, 371, 374, 376, 381; 379/430, 433.02, 379/452; 2/209, 906; 181/128, 129
See application file for complete search history.

(56) References Cited

U.S. PATENT DOCUMENTS

| | | | | |
|---|---|---|---|---|
| 3,661,225 | A | 5/1972 | Anderson | |
| 4,972,491 | A | 11/1990 | Wilcox, Jr. | |
| 5,136,639 | A | 8/1992 | Brito | |
| 5,138,722 | A * | 8/1992 | Urella et al. | 2/209 |
| 5,497,427 | A * | 3/1996 | Nageno | 381/381 |

* cited by examiner

*Primary Examiner*—Huyen Le
(74) *Attorney, Agent, or Firm*—Lerner, David, Littenberg, Krumholz & Mentlik, LLP

(57) ABSTRACT

A headphone device includes an earpad worn outside of the ear on the head of a user and a housing provided with a speaker unit as well as a fitting portion on which the earpad is fit. The earpad includes a cushion and a facing that covers the cushion. The earpad can be attached to and detached from the housing. The facing is detachable from the cushion to keep the earpad clean.

2 Claims, 8 Drawing Sheets

HEADPHONE DEVICE

CROSS-REFERENCE TO RELATED APPLICATIONS

This application is a continuation of U.S. application Ser. No. 09/914,976, filed on Sep. 6, 2001, the disclosure of which is hereby incorporated by reference herein, which is a U.S. National Stage Application of Application No. PCT/JP00/09426, filed Dec. 28, 2000, published in Japanese, which claims priority from Japanese Patent Application No. JP 2000-005975 filed on Jan. 7, 2000.

BACKGROUND OF THE INVENTION

The present invention relates to a headphone device. In particular, the present invention relates to a headphone device that includes a housing and an earpad fitted to the housing.

In the following, an example of a conventional headphone device will be described referring to FIG. 1 and FIG. 2.

The headphone device a includes a pair of headphone bodies b,b and a headband c.

The headphone body b has a housing d in which a speaker unit (not shown in the figure) is disposed and a pliable earpad e fitted to the inner surface of the housing d.

The housing d is formed of an outer shell f having an approximate dome shape and a fitting portion g arranged on the peripheral edge of the opening of the outer shell f. A fitting groove h is formed extending circumferentially between the outer shell f and the fitting portion g.

The earpad e includes an approximate circular ring-shaped cushion i internally wrapped up in a facing j. The facing j is comprised of a cylindrical ring-shaped wrapping portion k that wraps up the cushion i and a fitted portion 1 that protrudes inward from the outer periphery of the internal wrapping portion k. The earpads e are fitted onto the housings d by inserting both of the fitted portions 1, 1 into the fitting grooves h, h so as to cover the fitting portions g, g (see FIG. 2).

The headband c is curved upward forming a convex shape and has flexibility and elasticity. The headband c is provided as a spring member whose both ends are urged to approach each other. On both ends of the headband c hangers m, m are supported so that they can freely slide. These hangers m, m support the headphone bodies b, b allowing them to freely rotate on each on their ends.

An auxiliary band n is provided between the hangers m, m.

The headphone device a is worn on the head o in such a manner that the earpads e, e of the headphone bodies b, b cover the ears p, p of the head o (see FIG. 1). On this occasion a fixed side pressure is transferred to the head o through the headphone bodies b, b by means of the elasticity of the headband c. In addition, the auxiliary band n is worn in such a state that it is in contact with the head o from above (see FIG. 1).

Meanwhile, because the headphone device is worn with the earpad of the headphone main body being in direct contact with the human body, it is preferable to keep the earpad clean when taking hygiene into consideration. The number of users who have such concern about hygiene has increased more and more in recent years.

In this type of conventional headphone device a, however, although the earpads e, e can be removed from the housings d, d, because the cushions i, i are wrapped with the facing j, j, the facings j, j cannot be removed from the cushions i, i.

Consequently, washing the facing j along with the cushion i is considered in order to keep clean the earpad e that is in direct contact with the ear of the person. However, the cushion i is normally formed of a urethane material with poor resistance to water. For this reason, unfavorable conditions occur when washing the facing j along with the cushion i. In reality, the only method available is to remove any dirt on the surface to wipe off the facing j using a rag and when taking hygiene into consideration, this never provides satisfactory cleaning.

Thereupon, the present invention aims to overcome the above-mentioned problems by providing a headphone device in which the earpad can be kept clean to improve hygiene.

SUMMARY OF THE INVENTION

In order to solve the above-mentioned problem, the present invention provides a headphone device that includes an earpad to be worn from the outside of the ear on the head, and a housing that is provided with a speaker unit as well as a fitting portion on which the earpad is fit. The earpad is comprised of a cushion and a facing that covers the cushion. The earpad can also be attached to and detached from the housing and also the facing can be detached from the cushion.

Therefore, according to the headphone device of the present invention, the facing can be removed from the cushion.

DETAILED DESCRIPTION

In the following, an embodiment of the headphone device according to the present invention will be described with reference to FIG. 3 through FIG. 8.

Figure 1:
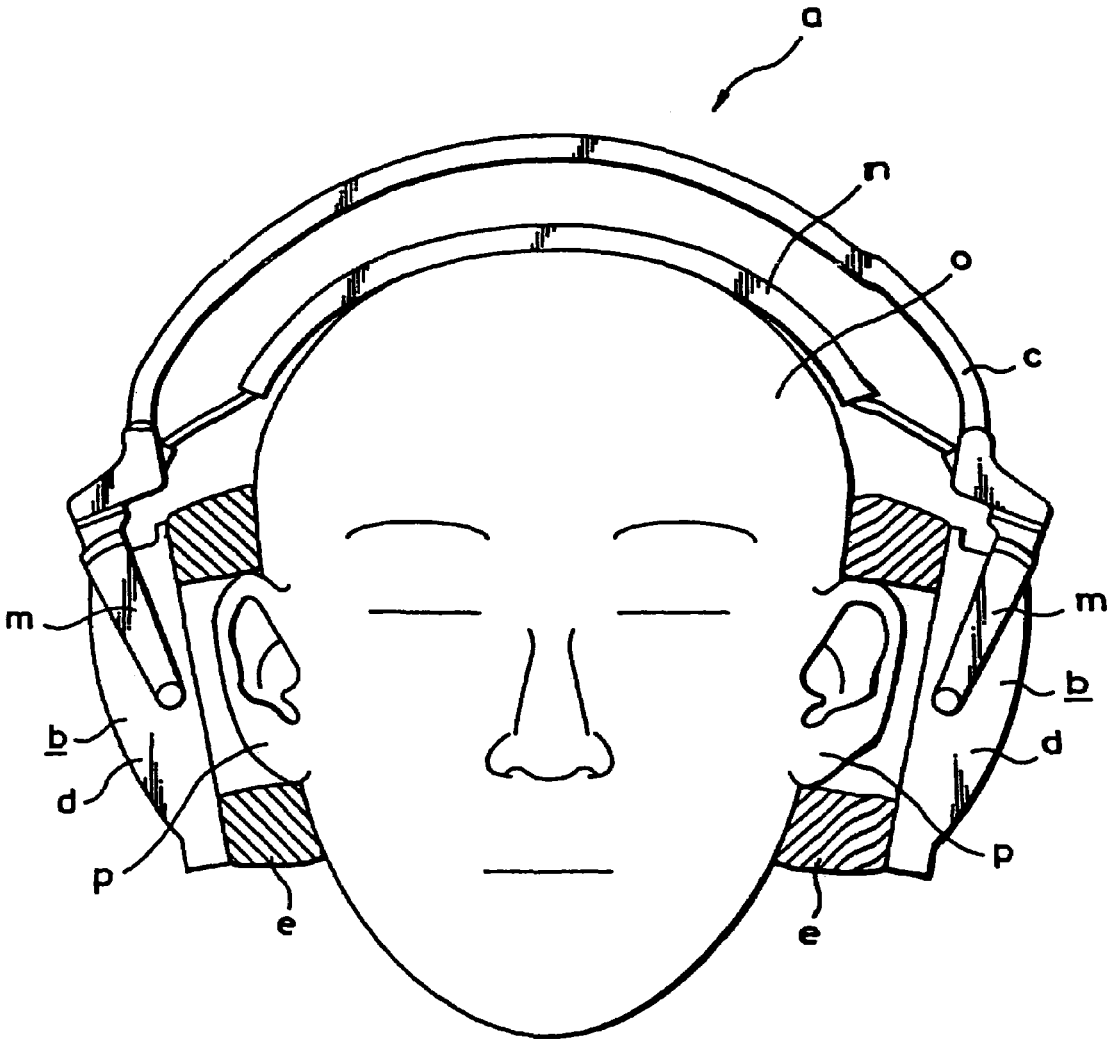
FIG. 1 (Prior Art)
FIG. 1 is a schematic front view of a conventional headphone device being worn on the head of a person. This figure has a cross section at one portion.
Figure 2:
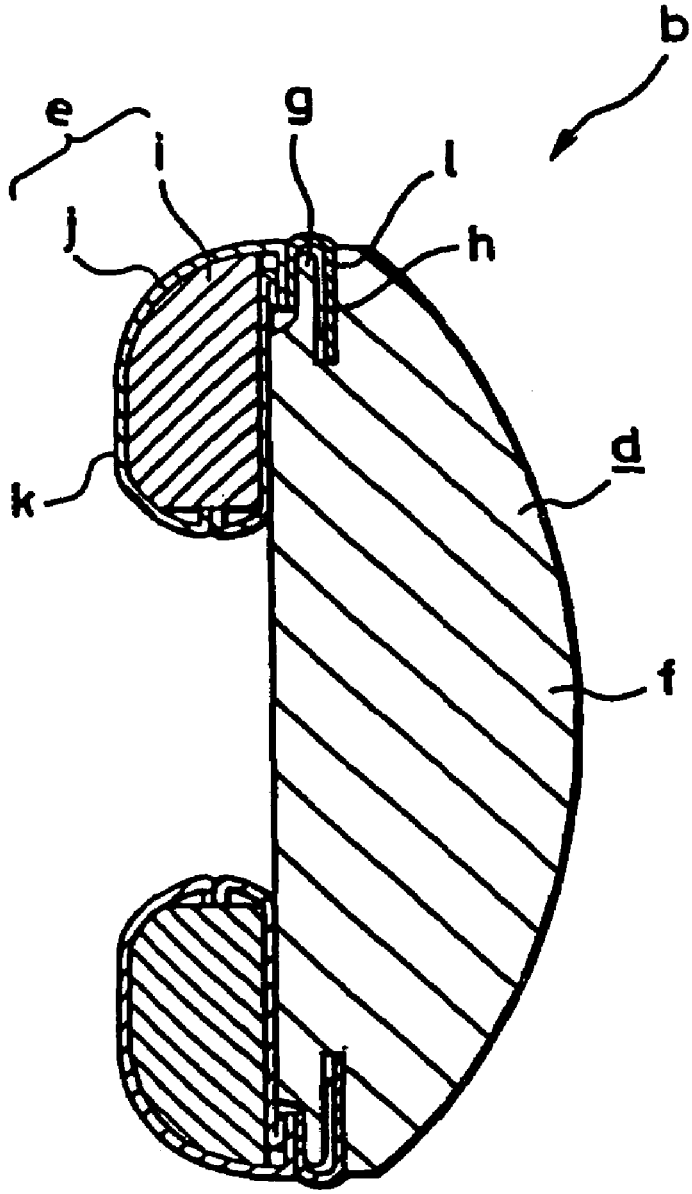
FIG. 2 (Prior Art)
FIG. 2 is a schematic longitudinal sectional view of the headphone body of the headphone device shown in FIG. 1.
Figure 3:
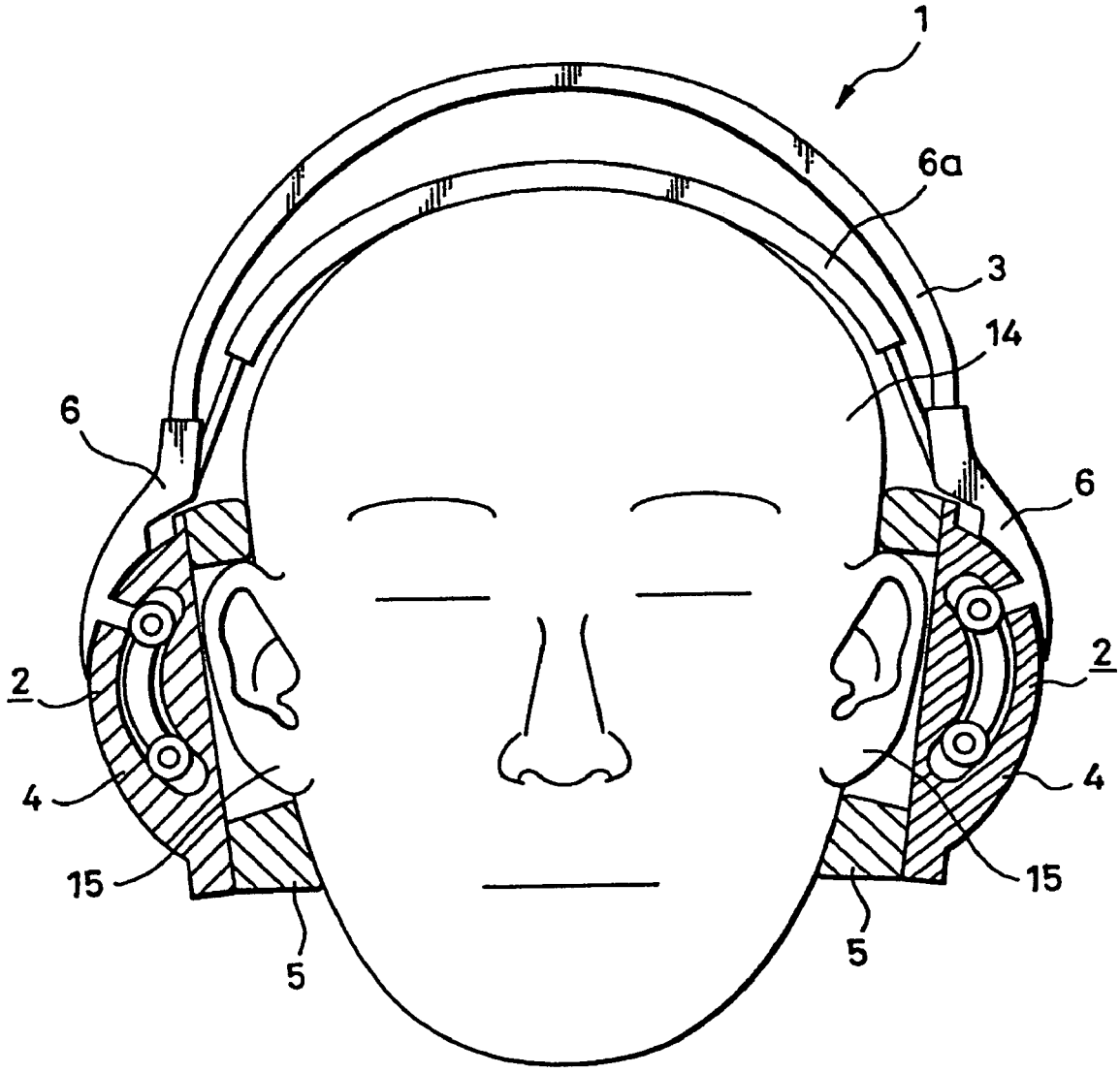
FIG. 3 is a schematic front view of the headphone device according to the present invention being worn on the head of a person. This figure has a cross section at one portion.

Referring to FIG. 3, the headphone device 1 is comprised of a pair of headphone bodies 2, 2 and a headband 3. The headphone bodies 2, 2 each have a housing 4 and a pliable earpad 5 fitted to the inner surface of the housing 4.

The headband 3 is curved upward forming a convex shape and has flexibility and elasticity. Further, the headband 3 is provided as a spring member whose both ends are urged to approach each other. On both ends of the headband 3 hangers 6, 6 are supported so that they can freely slide. These hangers 6, 6 each support a headphone body 2 through a rotation mechanism (not shown in figure) allowing it to freely rotate.

Figure 4:
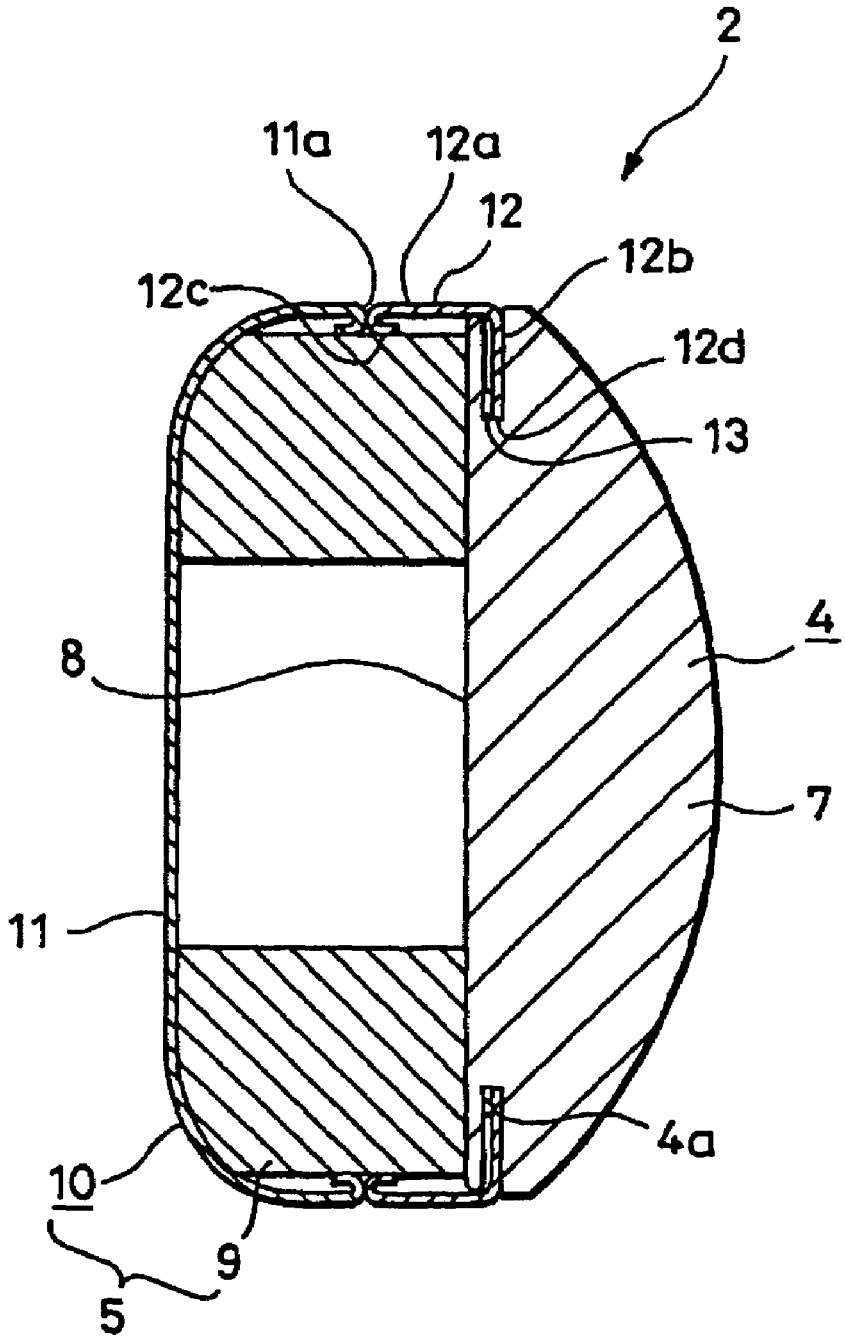
FIG. 4 is a schematic longitudinal sectional view of the headphone body of the headphone device shown in FIG. 3.

An auxiliary band 6*a* is provided between the hangers 6, 6. As shown in FIG. 4, each housing 4 is comprised of an outer shell 7 whose external shape forms an approximate dome shape and a disk-shaped fitting portion 8 arranged on one end side of the outer shell 7. A fitting groove 4*a* is formed extending circumferentially between the outer shell 7 and the fitting portion 8. A speaker unit (not shown in figure) is also disposed inside the housing 4.

Figure 5:
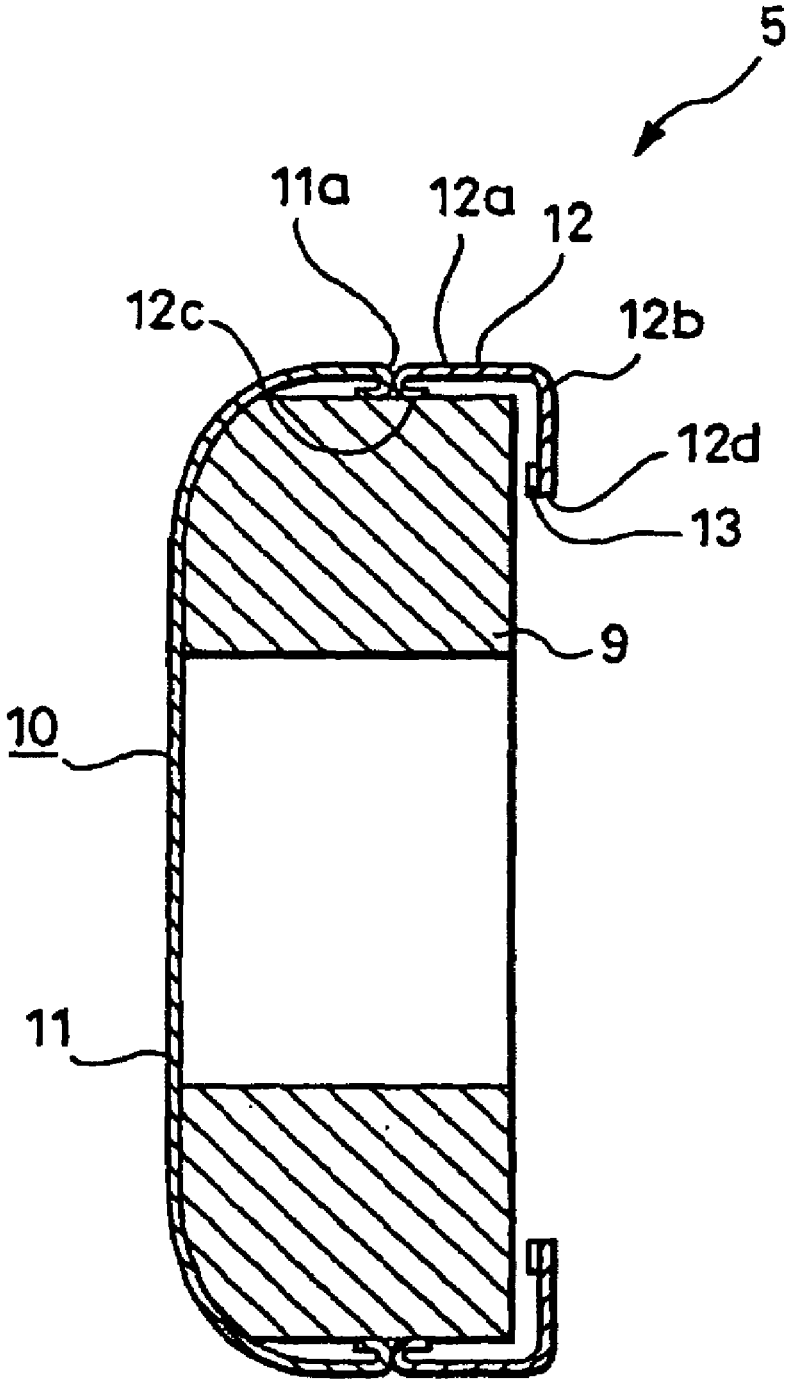
FIG. 5 is a schematic longitudinal sectional view of the earpad of the headphone device shown in FIG. 3.
Figure 6:
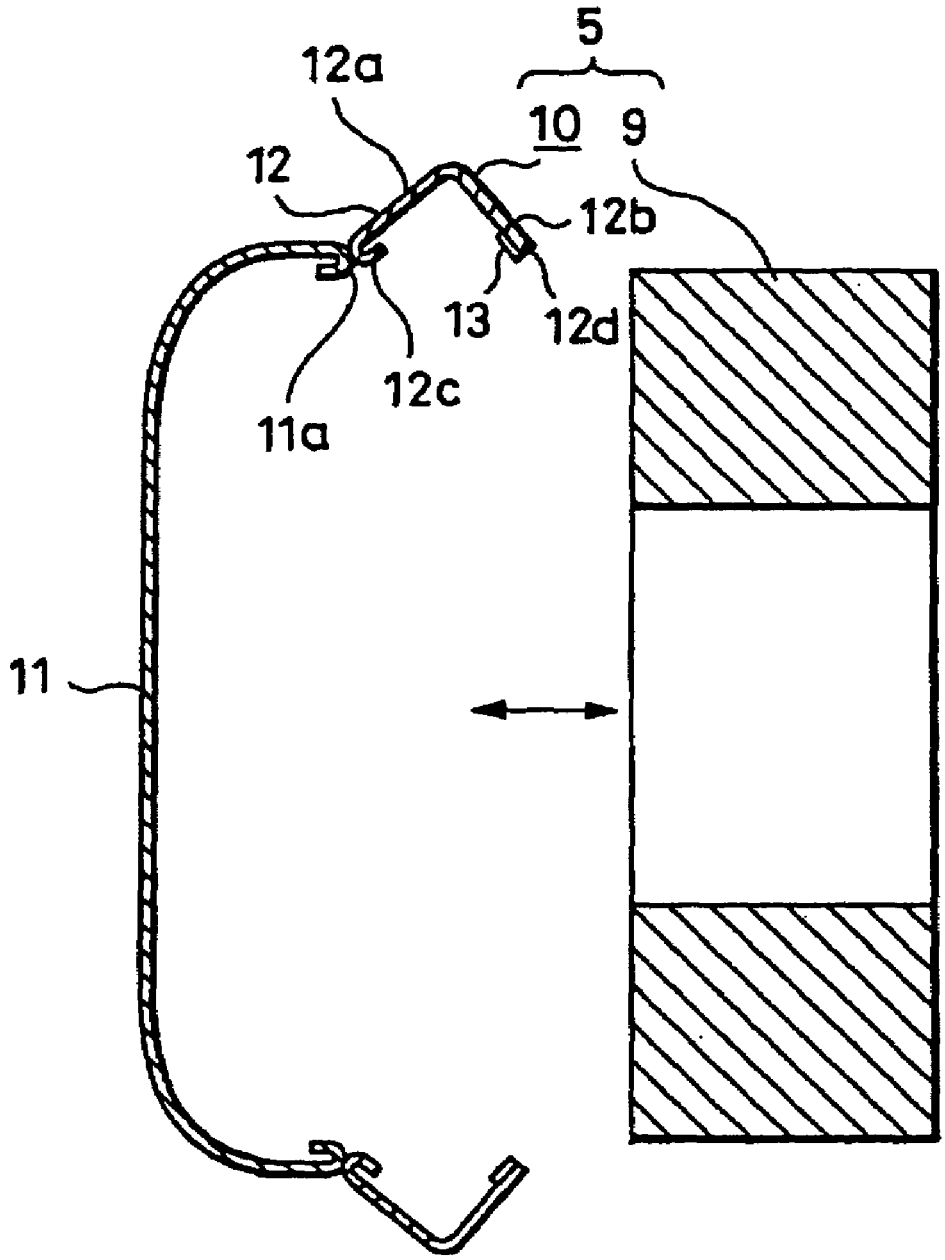
FIG. 6 is a schematic longitudinal sectional view showing the earpad of FIG. 5 with the cushion and facing detached from each other.

As shown in FIG. 4 to FIG. 6, the earpad 5 is such that one portion of a pliable cushion 9 made of, for example, urethane, is covered by a facing 10 made of, for example, synthetic leather or a cloth material and fitted on the fitting portion 8 of the housing 4. The cushion 9 has a circular shape slightly thick.

The facing 10 is comprised of a covering portion 11 and a fitted portion 12 seamed together. The external shape of the covering portion 11 is a round shallow container shape and its opening edge 11*a* is seamed to the fitted portion 12. The fitted portion 12 is formed of a ring-shaped peripheral surface portion 12*a* and a flange-shaped inserting portion 12*b* that protrudes from one end of the peripheral surface portion 12*a* towards the inside. The other end 12*c* of the peripheral surface portion 12*a* is seamed to the opening edge 11*a* of the covering portion 11. In addition, the opening on the inside of the inserting portion 12*b* is formed as an insertion/extraction opening 12*d* that functions for inserting and extracting the cushion 9 into and out of the facing 10.

A annular-shaped sheet 13 is bonded to the inner peripheral edge of the inserting portion 12*b* of the fitted portion 12. The sheet 13 is, for example, formed of a leather material that has a moderate hardness.

As shown in FIG. 4, the inserting portion 12*b* of the facing 10 is inserted to the inside of the fitting groove 4*a* of the housing 4 to attach the earpad 5 to the housing 4 in a state that the cushion 9 is inserted from the insertion/extraction opening 12*d* to the inside of the facing 10 as shown in FIG. 5. Because the sheet 13 is bonded on the inner peripheral edge of the inserting portion 12*b* and because of the sheet 13 itself, the thickness of the inner peripheral edge is increased to make the stiffness thereof enhanced, so that it is made easier to insert the inserting portion 12*b* into the fitting groove 4*a*.

Further, the earpad 5 can be removed from the housing 4 by removing the inserting portion 12*b* from the fitting groove 4*a*. Then, as shown in FIG. 6, the cushion 9 and the facing 10 are detached by removing the cushion 9 from the insertion/extraction opening 12*d*.

As shown in FIG. 3, the headphone device 1 is worn on the head 14 in such a manner that the earpads 5, 5 of the headphone bodies 2, 2 cover the ears 15, 15 of a head 14. At this moment a fixed side pressure is transferred to the head 14 through the headphone bodies 2, 2 due to the elasticity of the headband 3. In addition, as shown in FIG. 3, the auxiliary band 6*a* is worn in a state that it is in contact with the head 14 from above.

As described above, in this headphone device 1, the earpads 5, 5 can be removed from the housings 4, 4 and the facings 10, 10 can be detached from the cushions 9, 9.

Consequently, because the facings 10, 10 can be detached from the cushions 9, 9 making it possible to wash only the facings 10, 10, the earpads 5, 5 can always be kept clean and have improved hygiene.

Moreover, because the external shape of the cushion 9 of the earpad 5 is round in this headphone device 1, no directional consideration is required when fitting the facing 10 onto the cushion 9 eliminating the need to adjust the positions of both. This makes it possible to improve the operability during fitting work.

In the example described above, although the external shape of the cushion 9 is formed to be round, the external shape of the cushion can be formed in any number of different shapes such as a polygon, an ellipse or the like which make it easy to adjust the positions during fitting work.

Figure 7:
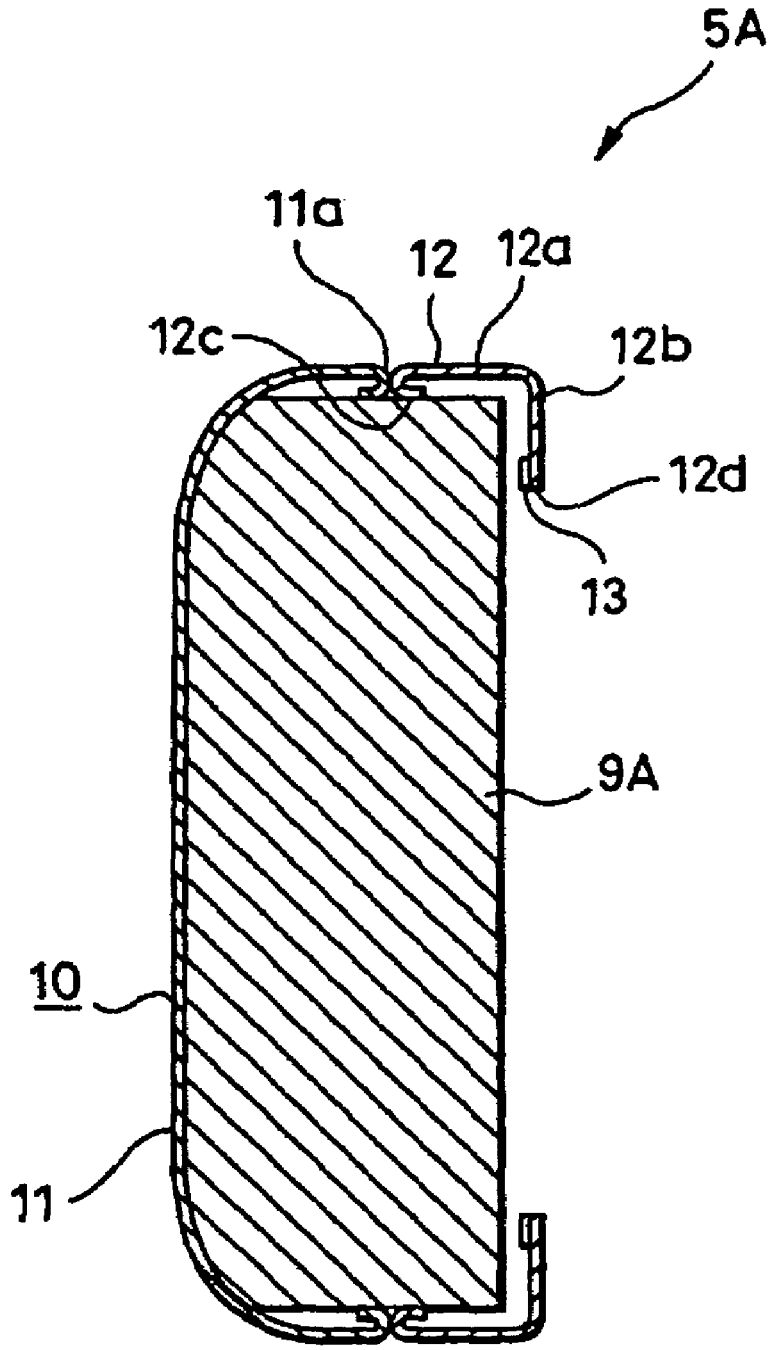
FIG. 7 is a schematic longitudinal sectional view showing the earpad equipped with a cushion that does not have a hole.

FIG. 7 shows an earpad 5A that uses a cushion 9A that does not have a hole formed at the center.

Figure 8:
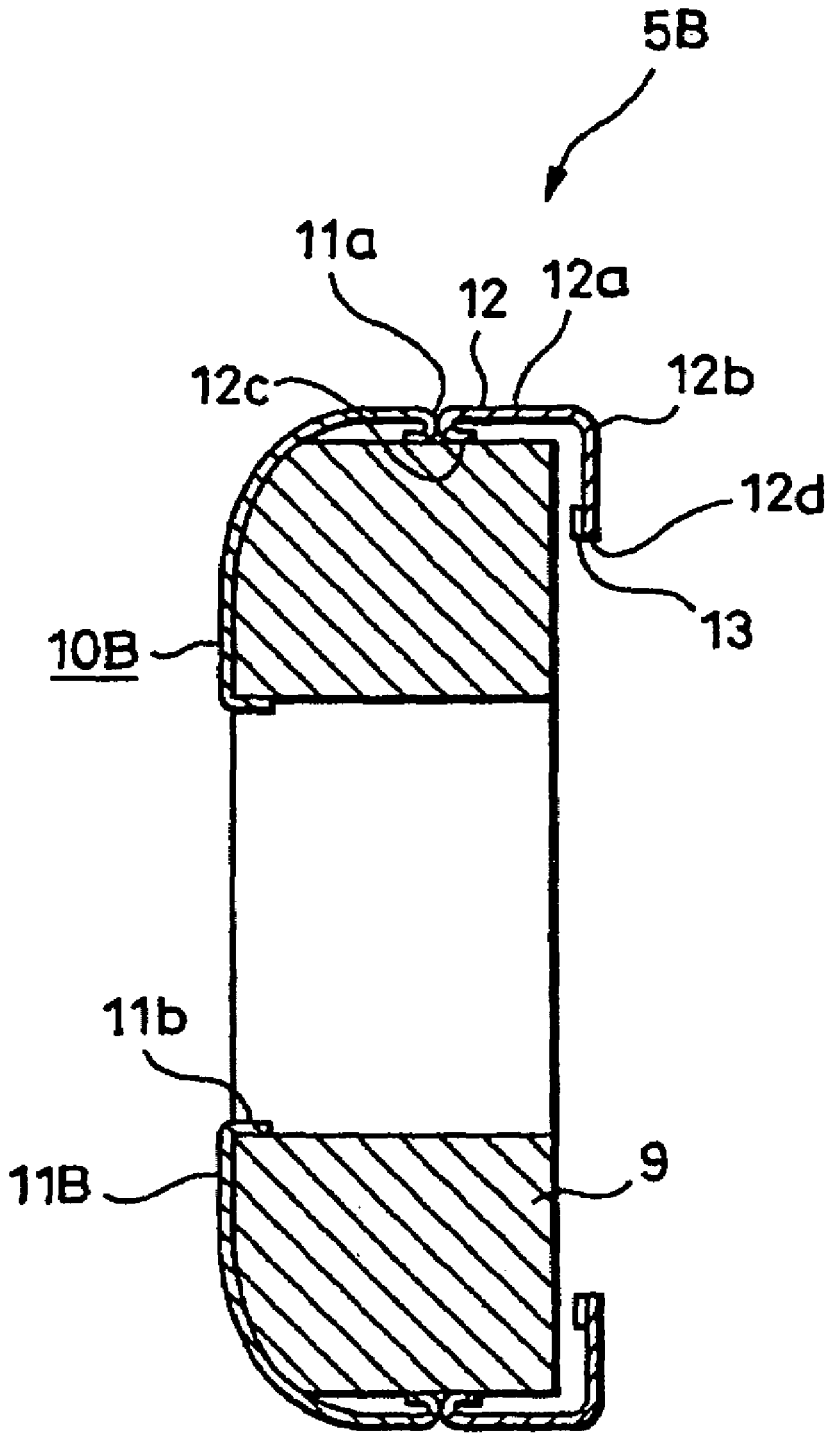
FIG. 8 is a schematic longitudinal sectional view showing the earpad equipped with a cushion that has a hole.

FIG. 8 shows an earpad 5B that uses a facing portion 10B that has a hole 11*b* formed at the center of the cover portion 11B in correspondence with the cushion 9.

In this manner, both earpads 5A, 5B shown in FIG. 7 or FIG. 8 are such that the facing 10 of the earpad 5A can be detached from the cushion 9A and in addition, the facing 10B of the earpad 5B can be detached from the cushion 9 as in the case of the earpad 5.

Therefore, the facing 10 or 10B are removed from the cushion 9A or 9 making it possible to wash only the facing 10 or 10B. Consequently, the earpad 5A or 5B can always be kept clean and have improved hygiene.

In addition, making it possible to detach the facing of the earpad from the cushion to improve the hygiene as described above is not limited to a headphone device but can also be applied to ear devices used for cold prevention or sound prevention as well.

The specific shapes and constructions of each part disclosed in the embodiment described above are only examples when implementing the present invention. They must not be interpreted as restricting the technical scope of the present invention.

As made clear by the description above, the headphone device according to the present invention comprises an earpad to be worn from the outside of the ear on the head, and a housing that is provided with a speaker unit as well as a fitting portion on which the earpad is fit. The earpad includes a cushion and a facing that covers the cushion. The earpad can also be attached to and detached from the housing and the facing can also be detached from the cushion.

Consequently, according to the headphone device of the present invention, because the facing can be removed from the cushion making it possible to wash only the facing, the earpad can always be kept clean and have improved hygiene.

Further, according to the headphone device of the present invention, because the external shape of the cushion of the earpad is round, there are no directional considerations when fitting the facing onto the cushion eliminating the need to adjust the positions of both. This makes it possible to improve the operability during fitting work.

The invention claimed is:

1. A headphone device, comprising:

an earpad including a cushion and a removable facing covering the cushion, the removable facing including a fitted portion and a covering portion which are joined together to form a hinge such that the fitted portion is movable relative to the covering portion to facilitate removal of the facing from the cushion; and a housing formed with a fitting portion adapted to hold the fitted portion of the removable facing for attaching the earpad to the housing via the removable facing, wherein the earpad is detachable from the housing, and wherein the removable facing is detachable from the cushion and the housing.

2. A headphone device as set forth in claim 1, wherein the cushion of the earpad has a circular external shape.

* * * * *